US007325768B2

(12) United States Patent
Byrd et al.

(10) Patent No.: US 7,325,768 B2
(45) **Date of Patent: *Feb. 5, 2008**

(54) HANDS-FREE PAPER TOWEL DISPENSERS

(75) Inventors: Dannie D. Byrd, Willmore, KY (US); Alain P. Cotnoir, Danville, KY (US); Adam T. Elliott, Lexington, KY (US); Victor Mendelsberg, Louisville, KY (US)

(73) Assignee: Wausau Paper Towel & Tissue, LLC, Mosinee, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/352,456

(22) Filed: Feb. 9, 2006

(65) Prior Publication Data

US 2006/0163416 A1 Jul. 27, 2006

Related U.S. Application Data

(60) Continuation of application No. 10/393,176, filed on Mar. 20, 2003, which is a division of application No. 09/538,453, filed on Mar. 30, 2000, now Pat. No. 6,695,246, which is a continuation-in-part of application No. 09/085,289, filed on May 27, 1998, now Pat. No. 6,105,898, which is a continuation of application No. 08/603,051, filed on Feb. 16, 1996, now Pat. No. 5,772,291.

(51) Int. Cl.
*B65H 26/00* (2006.01)

(52) U.S. Cl. ..... 242/563; 242/564.4

(58) Field of Classification Search ..... 242/563, 242/563.2, 564.1, 564.4, 596.3; 312/34.8, 312/34.22

See application file for complete search history.

(56) References Cited

U.S. PATENT DOCUMENTS 3,647,159 A 3/1972 Bump (Continued)

FOREIGN PATENT DOCUMENTS

CA 2093578 10/1994

(Continued)

OTHER PUBLICATIONS

LaCour Systems, Inc. *ille Toweltronic* brochure, undated; 1 page.
Notice of Opposition from SCA Hygiene Products AB for 0880331(only foreign patents cited in Opposition are enclosed and listed in Foreign Patent Documents above); dated 07/15/2005; 13 pages.
Notice of Opposition from Kimberly Clark Worldwide Inc. for 0880331 (only foreign patents cited in Opposition are enclosed and listed in Foreign Patent Documents above); dated Jul. 28, 2005; 17 pages.

(Continued)

*Primary Examiner*—John Q. Nguyen
(74) *Attorney, Agent, or Firm*—Merchant & Gould, P.C.

(57) ABSTRACT

A hands-free paper towel dispenser including a housing with a front cover that is pivotable between open and closed positions. A sensing mechanism is disposed entirely within the interior space of the cabinet at a location adjacent to the front cover and is oriented toward the front cover of the cabinet to permit detecting of an object adjacent the front cover without the object contacting the front cover. At least a portion of the sensing mechanism is accessible when the front cover is at the open position. A dispensing mechanism is disposed within the housing for dispensing a length of towel, with the dispensing mechanism including a drive roller and a motor in driving engagement with the drive roller. The dispenser also includes an electric power source for powering operation of the dispenser.

4 Claims, 7 Drawing Sheets

U.S. PATENT DOCUMENTS

| | | | | | |
|---|---|---|---|---|---|
| 3,650,487 | A | | 3/1972 | Bahnsen | |
| 3,730,409 | A | | 5/1973 | Ratti | |
| 3,917,142 | A | | 11/1975 | Guarderas | |
| 3,951,485 | A | | 4/1976 | Schnyder et al. | |
| 3,958,735 | A | | 5/1976 | Wanat | |
| 3,971,607 | A | | 7/1976 | Schnyder | |
| 4,108,513 | A | | 8/1978 | Lander | |
| 4,108,547 | A | | 8/1978 | Stemmle | |
| 4,119,255 | A | | 10/1978 | D'Angelo | |
| 4,131,044 | A | | 12/1978 | Cassia | |
| 4,165,138 | A | | 8/1979 | Hedge et al. | |
| 4,195,787 | A | | 4/1980 | Thomason | |
| 4,398,310 | A | | 8/1983 | Lienhard | |
| 4,430,682 | A | | 2/1984 | Babsch | |
| 4,522,346 | A | | 6/1985 | Jespersen | |
| 4,557,426 | A | | 12/1985 | Siciliano | |
| 4,666,099 | A | * | 5/1987 | Hoffman et al. | 242/564.1 |
| 4,676,131 | A | | 6/1987 | Cassia | |
| 4,721,265 | A | | 1/1988 | Hawkins | |
| 4,738,176 | A | * | 4/1988 | Cassia | 83/208 |
| 4,765,555 | A | | 8/1988 | Gambino | |
| 4,786,005 | A | | 11/1988 | Hoffman et al. | |
| 4,796,825 | A | | 1/1989 | Hawkins | |
| 4,826,262 | A | | 5/1989 | Hartman et al. | |
| 4,903,909 | A | | 2/1990 | Suzuki | |
| 4,944,464 | A | | 7/1990 | Zelenka | |
| 4,960,248 | A | | 10/1990 | Bauer et al. | |
| 5,031,258 | A | | 7/1991 | Shaw | |
| 5,060,323 | A | | 10/1991 | Shaw | |
| 5,086,526 | A | | 2/1992 | Van Marcke | |
| 5,131,302 | A | | 7/1992 | Watanabe | |
| 5,217,035 | A | | 6/1993 | Van Marcke | |
| 5,236,141 | A | | 8/1993 | Kewin | |
| 5,294,192 | A | | 3/1994 | Omdoll et al. | |
| 5,310,129 | A | | 5/1994 | Whittington et al. | |
| 5,356,086 | A | | 10/1994 | Takagi | |
| 5,405,069 | A | | 4/1995 | Duncan et al. | |
| 5,452,832 | A | * | 9/1995 | Niada | 225/11 |
| 5,605,001 | A | | 2/1997 | Derk | |
| 5,636,812 | A | | 6/1997 | Conner et al. | |
| 5,749,538 | A | | 5/1998 | Brown et al. | |
| 5,772,291 | A | | 6/1998 | Byrd et al. | |
| 5,829,713 | A | | 11/1998 | Kewin | |
| 5,833,169 | A | | 11/1998 | Morand | |
| 6,056,261 | A | | 5/2000 | Aparicio et al. | |
| 6,069,354 | A | | 5/2000 | Alfano et al. | |
| 6,105,898 | A | | 8/2000 | Byrd et al. | |
| 6,293,486 | B1 | | 9/2001 | Byrd et al. | |
| 6,302,352 | B1 | | 10/2001 | Applegate | |
| 6,386,479 | B1 | | 5/2002 | Lewis et al. | |
| 6,412,655 | B1 | | 7/2002 | Stuetzel et al. | |
| 6,412,679 | B2 | | 7/2002 | Formon et al. | |
| 6,419,136 | B2 | | 7/2002 | Formon et al. | |
| 6,491,251 | B1 | | 12/2002 | Stanland et al. | |
| 6,695,246 | B1 | | 2/2004 | Elliott et al. | |
| 2002/0088837 | A1 | | 7/2002 | Formon et al. | |
| 2004/0035976 | A1 | | 2/2004 | Byrd et al. | |

FOREIGN PATENT DOCUMENTS

| | | | | |
|---|---|---|---|---|
| DE | 36 03 638 | | | 8/1987 |
| DE | 37 06 229 | | | 3/1988 |
| DE | 38 43 851 | | | 6/1990 |
| DE | 91 12 143.4 | | | 9/1991 |
| DE | 91 13 931.7 | U1 | | 2/1992 |
| DE | 19820978 | | | 11/1999 |
| EP | 0 195 751 | A2 | | 9/1986 |
| EP | 0 235 438 | A1 | | 9/1987 |
| EP | 0412169 | | | 2/1991 |
| FR | 2649603 | | | 1/1991 |
| GB | 2 245 882 | A | | 1/1992 |
| GB | 2 247 623 | | | 3/1992 |
| JP | 58002152 | A | | 1/1983 |
| JP | 63-171532 | | | 7/1988 |
| NL | 8602194 | | | 3/1988 |
| WO | 90/09755 | | | 9/1990 |
| WO | WO90/09755 | | * | 9/1990 |
| WO | 99/58040 | | | 11/1999 |

OTHER PUBLICATIONS

Notice of Opposition from SCA Hygiene Products AB for EP 1386572 (only foreign patents cited in Opposition are enclosed and listed in Foreign Patent Documents above); dated May 29, 2006; 38 pages.

Notice of Opposition from SCA Hygiene Products AB for EP 1405590 (only foreign patents cited in Opposition are enclosed and listed in Foreign Patent Documents above); dated May 15, 2006; 34 pages.

Notice of Opposition from Kimberly Clark Worldwide, Inc. for EP 1405590 (only foreign patents cited in Opposition are enclosed and listed in Foreign Patent Documents above); dated May 15, 2006; 26 pages.

Notice of Opposition from ILLE Papier-Service GmbH for 0880331; dated Jul. 28, 2005; 13 pages (translation).

* cited by examiner

HANDS-FREE PAPER TOWEL DISPENSERS

This application is a continuation of U.S. patent application Ser. No. 10/393,176, filed on Mar. 20, 2003 (pending); which is a divisional of U.S. application Ser. No. 09/538,453, filed Mar. 30, 2000, now U.S. Pat. No. 6,695,246; which is a continuation-in-part of U.S. patent application Ser. No. 09/085,289, filed on May 27, 1998, now U.S. Pat. No. 6,105,898; which is a continuation of U.S. patent application Ser. No. 08/603,051, filed on Feb. 16, 1996, now U.S. Pat. No. 5,772,291.

FIELD OF THE INVENTION

The invention disclosed herein relates to towel dispensers and methods for dispensing towels. More particularly, the invention disclosed herein relates to electric "hands-free" towel dispensers and methods for dispensing towels without use of the hands.

BACKGROUND OF THE INVENTION

Towel dispensers are known and are shown in U.S. Pat. Nos. 3,647,159; 4,131,044; and 4,165,138. For example, Bump, U.S. Pat. No. 3,647,159, shows a towel dispenser having an automatic towel length controlling means and roll support tensioning means. The towel dispenser disclosed generally comprises a shell, means within the shell for rotatably supporting a roll of paper toweling, a frictional power roller engaging a paper web from the roll, and means for limiting the length of individual paper towels withdrawn from the dispenser. The latter means includes a first gearlike member rotatable with the power roll, a second gearlike member rotatable in response to rotation of the first gearlike member, a finger carried by the second gearlike member, a strap mounted for linear movement on the dispenser between a first position and a second position, an abutment surface carried by the strap in a position intersecting the excursion path of the finger when the strap is in a first position, a limit abutment carried by the strap in a position intersecting the excursion path of the finger when the strap is in the second position, means temporarily holding the strap in the second position and means urging the strap toward the first position. The strap is moved toward the second position by contact of the finger with the abutment surface in response to rotation of the second gearlike member.

Electronic towel dispensers are also known. U.S. Pat. Nos. 3,730,409; 3,971,607; 4,738,176; 4,796,825; and 4,826,262 each disclose electronic towel dispensers. For example, in Ratti, U.S. Pat. No. 3,730,409, a dispenser comprises a cabinet having a supply roll of paper towel therein and an electric motor-driven dispensing roll frictionally engaging the towel web for advancing it through a dispensing opening past a movable cutter. The cutter is biased to a normal rest position and is movable to a severing position in response to the manual cutting action by a user. The dispenser further comprises a control circuit including a normally closed start switch and a normally open ready switch connected in a series between the motor and an associated power source. The normally open stop switch is in parallel with the ready switch. Program apparatus is coupled to the cutter, the motor and the control circuit and is responsive to movement of the cutter to its severing position for opening the start switch and closing the ready switch. Movement of the cutter back to its normal rest position recloses the start switch to energize the motor. The program apparatus is responsive to operation of the motor for sequentially closing the stop switch then reopening the ready switch and then reopening the stop switch to de-energize the motor.

Finally, "hands-free" systems for controlling the operation of washroom fixtures such as water faucets, soap dispensers and towel dispensers are known. Examples of such hands-free systems are disclosed in U.S. Pat. Nos. 4,796,825; 5,031,258; 5,060,323; 5,086,526; and 5,217,035. In Hawkins, U.S. Pat. No. 4,796,825, an electronic paper towel dispenser is shown which permits paper towels to be dispensed from a supply roll by placing a hand or other object in front of a sensor located on the front of the supply cabinet. Dispensing of the paper towels is stopped when the hand is removed or when normal room lighting is not available. The dispensing of towels is controlled by a touchless switch for energizing a motor means.

The problem with prior hands-free electronic dispensers is that they require a source of electricity such as AC current from a plug-in wall outlet to power the hands-free mechanism. This can be dangerous to a user, especially when the dispenser is near a sink or other source of water. Another problem is that many prior hands-free dispensers are complicated devices which are expensive to manufacture and difficult to maintain in working order. Still another problem is that prior hands-free dispensers continue to dispense paper so long as the user's hand remains in front of the sensor. Also, if a change in ambient light occurs, prior hands-free dispensers have to be manually reset to adjust to a new light reference.

Therefore, it would be advantageous to provide improved towel dispensers for automatically dispensing a length of towel in response to the movement of an object such as a user's hands. In this manner, a user can avoid contact with viruses or bacteria on the dispenser left by prior users' hands. It would be further advantageous to provide energy-efficient hands-free dispensers which utilize light energy. It would also be advantageous to provide hands-free dispensers which are simple in design, safe and easy to use. It would be even further advantageous to provide hands-free dispensers which are inexpensive to manufacture and free from problems such as inoperability due to jamming or changes in ambient light conditions.

SUMMARY OF THE INVENTION

The invention relates to towel dispensers and methods for dispensing towels. More particularly, the invention relates to electric "hands-free" towel dispensers and methods for dispensing towels without use of the hands.

In one aspect of the invention, the hands-free paper towel dispenser comprises:

(a) a cabinet defining an interior space sufficient to house a main paper towel roll and a stub paper towel roll, the cabinet including a front cover that is pivotally attached to thereto so that the front cover is pivotable between an open position and a closed position;

(b) a sensing mechanism disposed entirely within the interior space of the cabinet at a location adjacent to the front cover, the sensing mechanism being oriented toward the front cover to permit detecting of an object adjacent the front cover without the object contacting the front cover, and at least a portion of the sensing mechanism is accessible when the front cover is at the open position;

(c) a dispensing mechanism disposed within the housing for dispensing a length of towel, the dispensing mechanism including a drive roller and a motor in driving engagement with the drive roller;

(d) control circuitry that controls operation of the sensing mechanism and the motor, controls the length of towel that is dispensed, and provides a delay between cycles of towel dispensing; and (e) an electric power source for powering operation of the dispenser.

These and various other advantages and features of novelty which characterize the invention are pointed out with particularity in the claims annexed hereto and forming a part hereof. However, for a better understanding of the invention, its advantages and objects obtained by its use, reference should be made to the drawings which form a further part hereof, and to the accompanying description, in which there is described a preferred embodiment of the invention.

DESCRIPTION OF THE DRAWINGS

These and other features of the invention will now be described with reference to the drawings of preferred embodiments, which are intended to illustrate and not to limit the invention and in which.

DETAILED DESCRIPTION OF THE INVENTION

As used throughout the specification, including the claims, the term "hands-free" means control of a dispensing mechanism without the need for use of hands.

In addition, as used throughout the specification, including the claims, the term "towel" refers generally to an absorbent paper or other suitable material used for wiping or drying.

Figure 1:
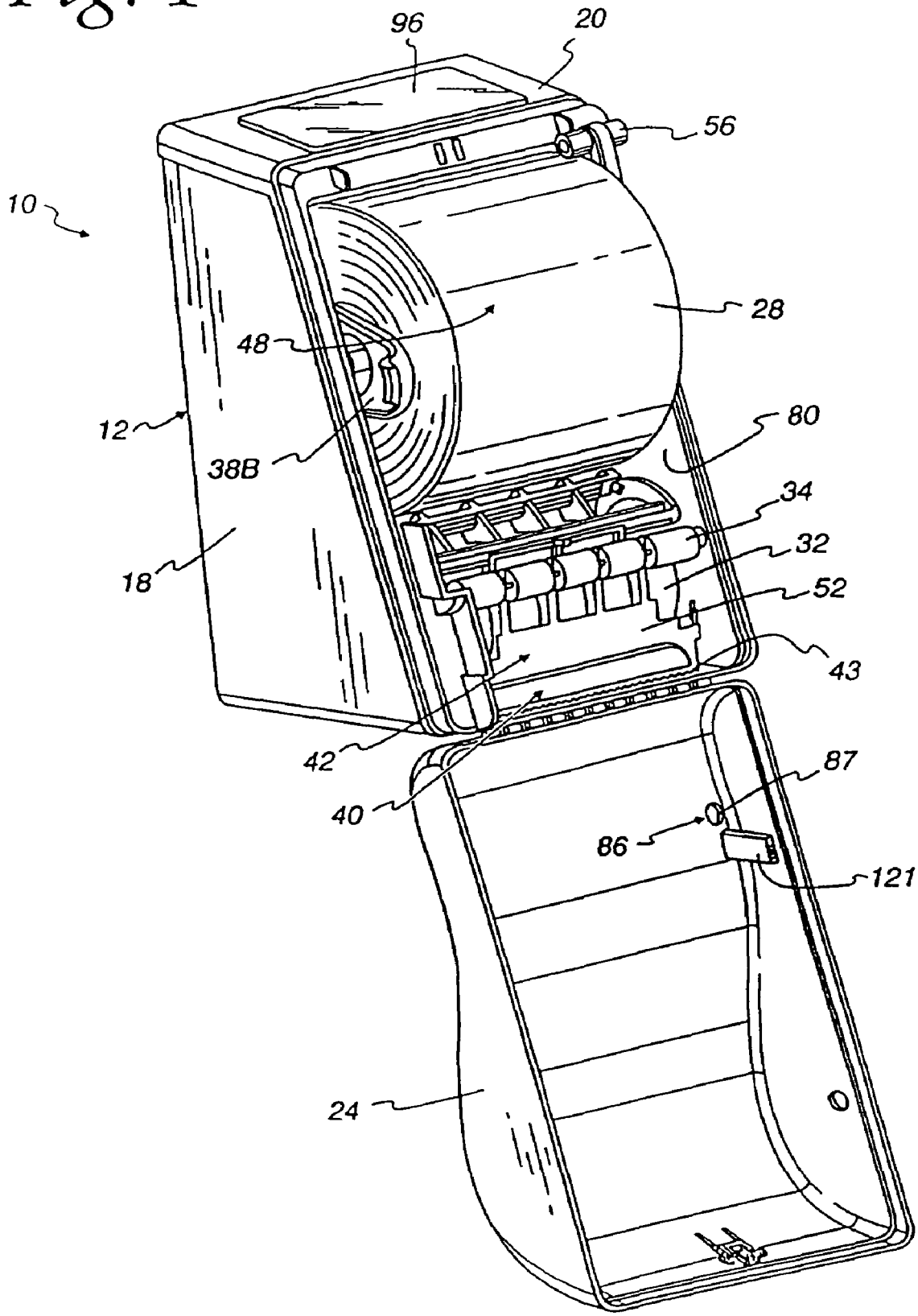
FIG. 1 is a perspective view of an embodiment of the towel dispenser of the invention.

As shown in FIG. 1, in a preferred embodiment of the invention, a hands-free towel dispenser 10 comprises a cabinet 12 comprising a back wall 14, two side walls 16, 18, a top wall 20, a bottom or base wall 22, and an openable and closable front cover 24. The front cover 24 may be pivotally attached to the cabinet, for example, by hinge 26, for easy opening and closing of the cover 24 when a supply of towels such as main roll 28 is placed in the cabinet 12. The towel dispenser 10 may be mounted to a wall or other supporting member by any convenient means such as brackets, adhesives, nails, screws or anchors (not shown).

Figure 2:
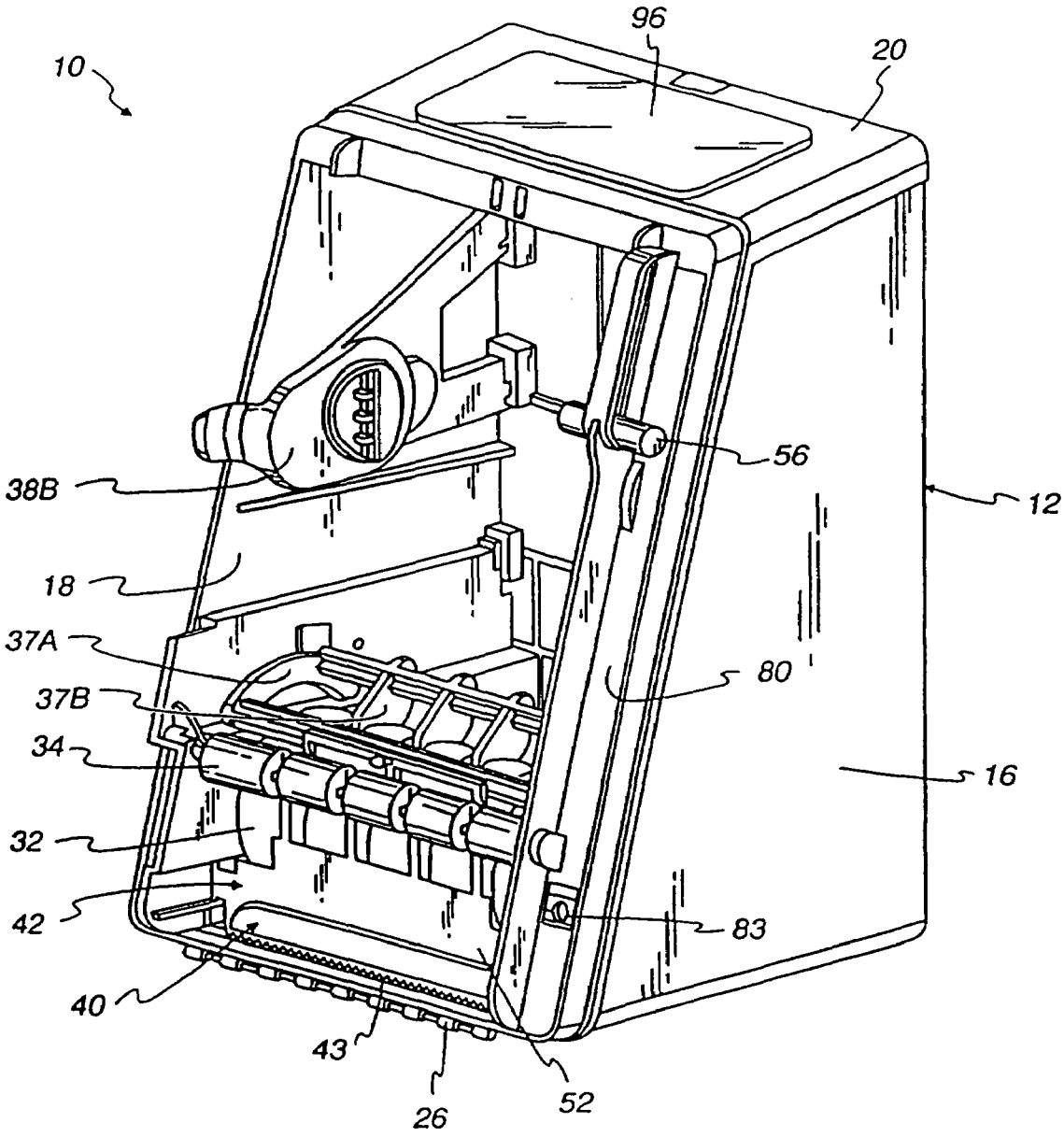
FIG. 2 is a perspective view of the towel dispenser of FIG. 1 with the towel roll removed.
Figure 3:
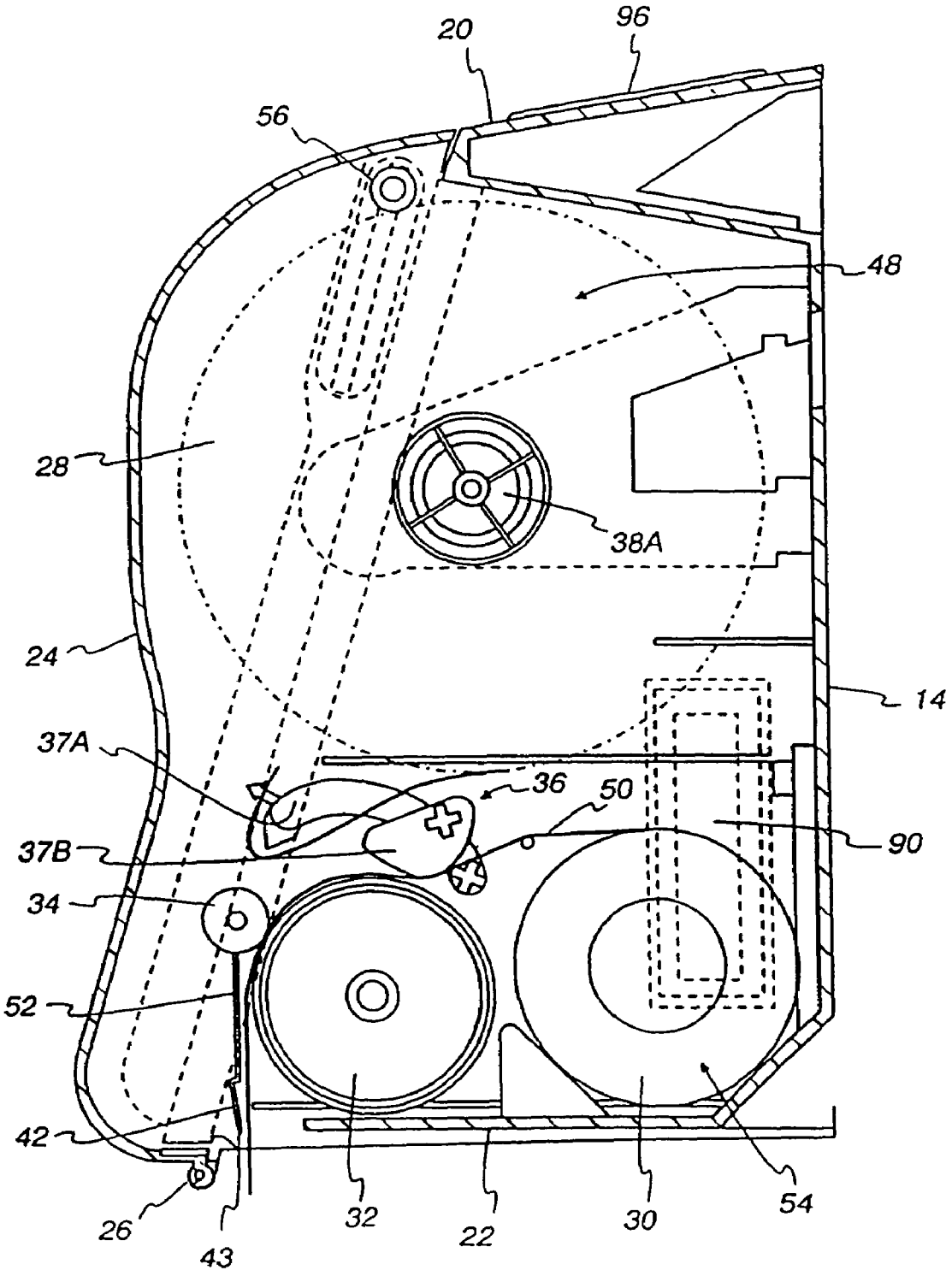
FIG. 3 is a sectional view of a side elevation of the towel dispenser of FIG. 2.
Figure 4:
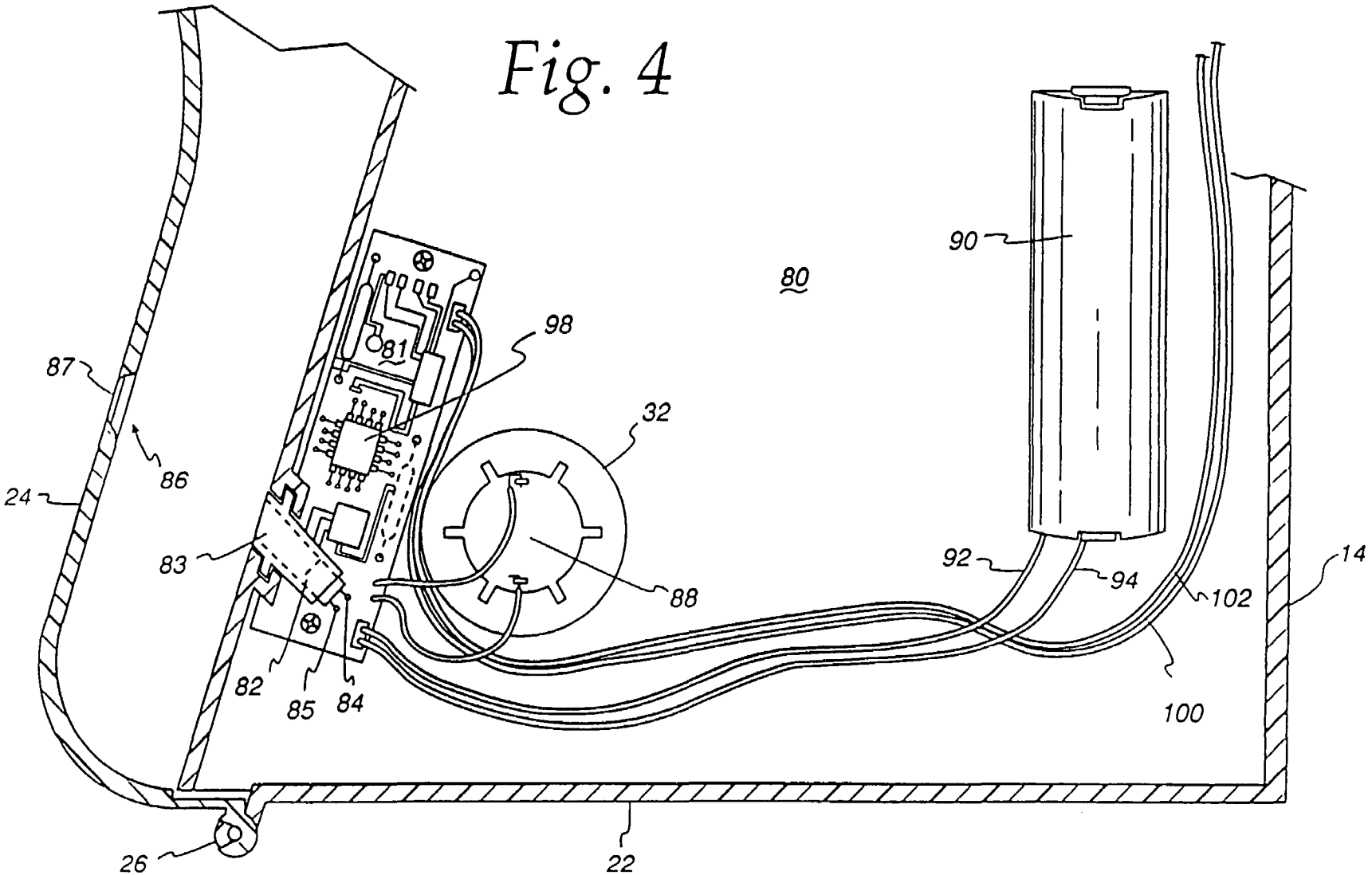
FIG. 4 is a board layout for a mechanical plate used in the dispenser of the invention.

As shown in more detail in FIGS. 2, 3 and 4, the hands-free dispenser 10 further comprises a dispensing mechanism for dispensing a length of towel to the outside of the dispenser 10. Such dispensing mechanism may comprise drive roller 32, pinch roller 34, transfer bar 36 and roll support cup 38*a* and roll support arm 38*b*. The dispensing mechanism enables dispensing of a predetermined length of towel to the outside of the towel dispenser 10 through slot 40, where the towel can be grasped by the user and torn off along a serrated edge 43 of a blade 42.

The dispensing mechanism operates to dispense towels either from a main roll 28 or a stub roll 30. The means for controlling dispensing of a paper from the main roll 28 once the stub roll 30 has been depleted comprises a transfer bar 36, which is described in detail in U.S. Pat. No. 4,165,138, the disclosure of which is incorporated by reference herein.

As shown in FIGS. 1, 2 and 3, main roll 28 is first loaded into the cabinet 12 onto roll support cup 38*a* and roll support arm 38*b* located opposite each other on side walls 16, 18, respectively, and forming main roll station 48 (FIG. 1). A length of towel from main roll 28 is then threaded behind transfer bar 36 including a fork 37*a* and a cam 37*b*, and over drive roller 32 so that towel sheeting 50 will be pulled between the drive roller 32 and the pinch roller 34 in a generally downward motion when the drive roller 32 is rotated by operation of a motor 88 shown in FIG. 4. As the towel sheeting 50 is pulled downwardly, it is guided along a wall 52 of the serrated blade 42 and out slot 40.

The length of towel sheeting 50 dispensed from towel dispenser 10 can be set to any desired length. Preferably, the dispenser 10 releases about ten to twelve inches of towel sheeting 50 per dispensing cycle. The towel sheeting 50 is then removed by tearing the length of dispensed towel sheeting 50 at the serrated edge 43 of blade 42.

When the main roll 28 has been partially depleted, preferably to about a four-inch diameter as indicated by low paper indictor 56, the dispenser cover 24 is opened by an attendant, and the main roll 28 is moved down to a stub roll station 54. The main roll 28 then becomes stub roll 30 and enables a new main roll 28 to be loaded onto roll support cup 38*a* and roll support arm 38*b* in main roll station 48. When stub roll 30 is completely depleted the new main roll 28 begins feeding paper 50 between the drive roller 32 and pinch roller 34 out of the dispenser 10 when the motor 88 is activated.

When the low paper indicator 56 indicates that the new main roll 28 is low, the attendant opens cover 24, an empty core (not shown) of stub roll 30 is removed from the stub roll station 54 and discarded, and new main roll 28 is dropped into position into the stub roll station 54 where it then becomes stub roll 30 and continues feeding. A main roll 28 is then positioned on the roll support cup 38*a* and roll support arm 38*b*. The basic transfer mechanism for continuously feeding towels from a stub roll until completely used and then automatic transfer to a main roll is described in detail in U.S. Pat. No. 4,165,138.

Hands-free operation of the dispenser 10 is effected when a person places an object such as their hands in front of a photo sensor 82 shown in FIG. 4. The photo sensor 82 activates the motor 88 to dispense a predetermined length of towel sheeting 50. The dispenser 10 has electric circuitry which, as will be described below with reference to FIGS. 4–8, ensures safe, efficient and reliable operation of the dispenser 10.

Referring now to FIG. 4, a cutaway view of a portion of the dispenser 10 is shown. In FIG. 4, a circuit board 81 is mounted to a mechanical plate 80 of the dispenser 10. Note that the circuit board is mounted between the mechanical plate 80 and the wall 16 of the cabinet 12. The photo sensor 82 is seated within a mounting tube 83 and is coupled to the circuit board 81 by leads or wires 84, 85. As will be described below with reference to FIG. 5, the photo sensor 82 reacts to changes in light intensity. Light passes from a room, through an opening 86 in the movable front cover 24 of the dispenser 10, to the photo sensor 82. A clear plastic lens 87 is fitted into the opening 86. The lens 87 prevents debris from clogging or blocking the opening 86 which might prevent light from reaching the sensor 82. The lens 87 also prevents debris from falling into the dispenser 10 which might cause the dispenser 10 to malfunction.

Also shown in FIG. 4 is the motor 88 which is attached to the drive roller 32. The motor 88, including a gearbox (not shown), are available from Skil Corporation in Chicago, Ill. The motor 88 is placed partially within the drive roller 32 and is powered by a rechargeable battery 90, also available from Skil Corporation. The battery 90 is coupled to the motor 88 via the circuit board 81 by wires or leads 92, 94 which are connected or soldered to the circuit board 81.

A solar panel 96, is located on the top 20 of the dispenser 10 as shown in FIG. 1. The solar panel 96 shown, which comprises an array of one or more photovoltaic cells, is made by Solarex Corporation in Frederick, Md. The solar panel 96 is coupled to the battery 90 and control circuitry 98 via the circuit board 81 by wires or leads 100, 102 which are connected or soldered to the circuit board 81 also.

The solar panel 96 provides power to control circuitry 98 for controlling the dispensing mechanism of the dispenser 10. In a preferred embodiment, the solar panel 96 provides power to control circuitry 98 (FIG. 5) which will manage motion sensing, rotation control, safety features, and recharging of the battery 90. In a second embodiment, the solar panel 96 provides power to the control circuitry 98 which will manage motion sensing, rotation control and safety features, but the battery 90 will be replaced at desired intervals and will not be recharged by the control circuitry 98. When the solar panel 96 is not exposed to light, the solar panel 96 does not supply power to the control circuitry 98 and the motor 88 cannot be turned on. The solar panel 96 functions as an on-off switch for the dispenser 10 and thereby prevents the battery 90 from becoming unnecessarily discharged when the lights are off. If the control circuitry 98 is not powered by the solar panel 96, the motor 88 cannot be turned on.

Figure 5:
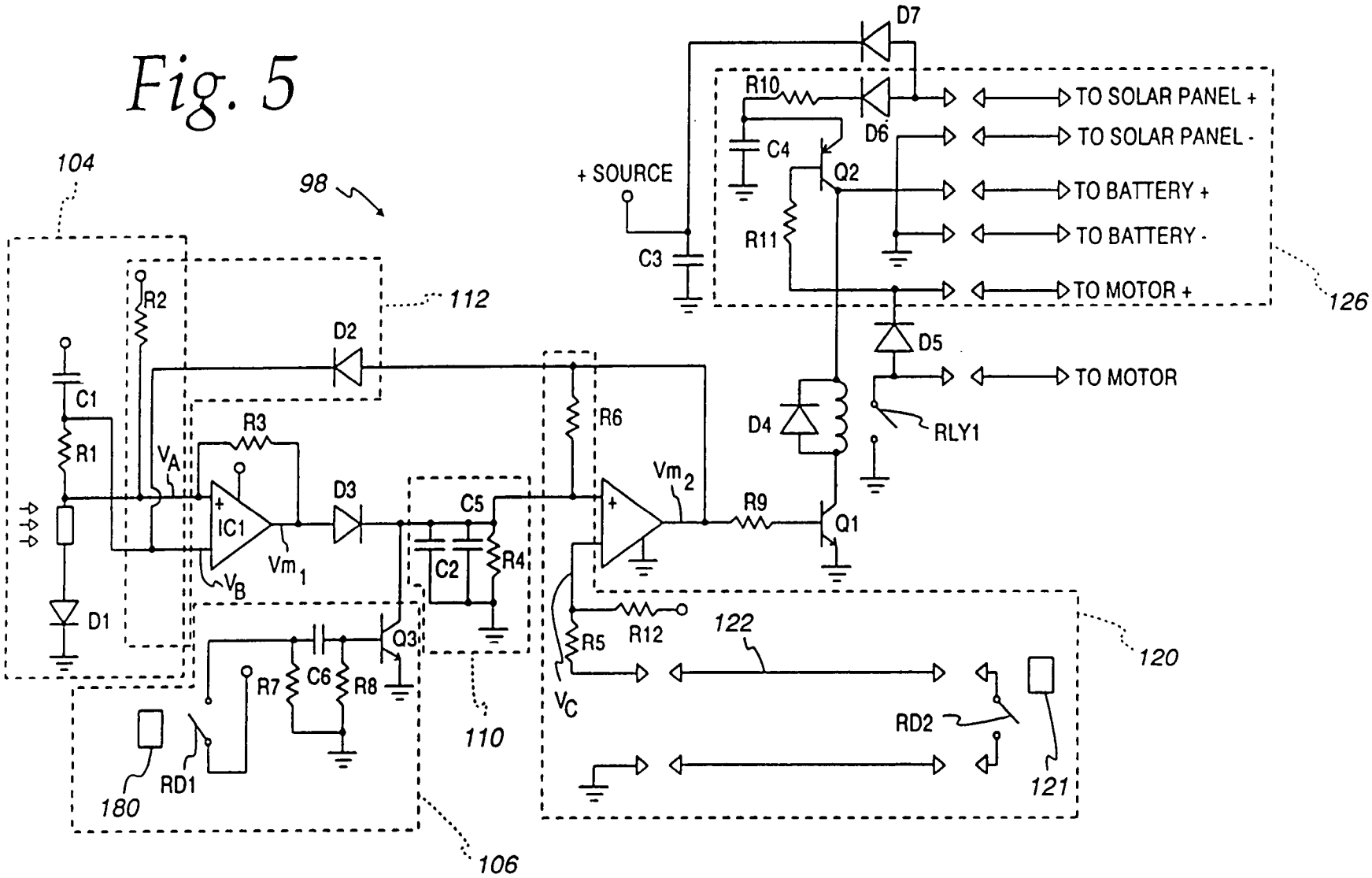
FIG. 5 is a schematic diagram for the electric circuit of the invention.

Referring now to FIG. 5, a schematic diagram of the control circuitry 98 is shown. The control circuitry 98 controls the "hands-free" operation of the dispenser 10. More specifically, the control circuitry 98 controls and/or performs the following functions: (1) sensing when an object such as a person's hand is in front of the photo sensor 82 and turning the motor 88 on; (2) sensing when the proper length of towel sheeting 50 has been dispensed and then turning the motor 88 off; (3) sensing when towel sheeting 50 has jammed inside of the dispenser 10 and turning the motor 88 off; (4) sensing when the front cover 24 of the dispenser 10 is open and preventing operation of the motor 88; (5) creating a short delay, preferably about two seconds, between dispensing cycles; and (6) charging of the battery 90 by the array of one or more photovoltaic cells 96.

The values of the components shown in the schematic diagram of FIG. 5 are as listed below:

| RESISTORS | |
|---|---|
| R1 = | $1 \times 10^6$ ohm |
| R2 = | $520 \times 10^3$ ohm |
| R3 = | $1 \times 10^6$ ohm |
| R4 = | $3 \times 10^6$ ohm |
| R5 = | $3.3 \times 10^6$ ohm |

-continued

| | |
|---|---|
| R6 = | $10 \times 10^6$ ohm |
| R7 = | $1 \times 10^6$ ohm |
| R8 = | $20 \times 10^3$ ohm |
| R9 = | 680 ohm |
| R10 = | 8 ohm |
| R11 = | $1 \times 10$ ohm |
| R12 = | $1 \times 10^6$ ohm |
| CAPACITORS | |
| C1 = | $1 \times 10^{-6}$ Farad |
| C2 = | $1 \times 10^{-6}$ Farad |
| C3 = | $104 \times 10^{-6}$ Farad |
| C4 = | $104 \times 10^{-6}$ Farad |
| C5 = | $1 \times 10^{-6}$ Farad |
| C6 = | $1 \times 10^{-6}$ Farad |

OTHER COMPONENTS

All diodes are part nos. IN4148 or IN914 from Diodes, Inc.

Operational Amplifiers IC1A and IC1B are on circuit board ICL7621DCPA from Maxim.

Transistors Q1 and Q2 are part no. 2N3904 from National.

Transistor Q3 is part no. 2N3906 from National.

Solar cell is part no. NSL-4532 or NSL-7142 from Solarex.

Reed switches RD1 and RD2 are part no. MINS1525-052500 from CP-CLAIRE.

Relay RLY1 is part no. TF2E-3V from AROMAT.

The photo sensor 82 shown is a Cadmium Sulfide ("CDS") motion detector manufactured by Silonex Corporation located in Plattsburg, N.Y. The photo sensor 82 is a variable resistance resistor. The resistance of the photo sensor 82 changes depending on the amount of light to which the photo sensor 82 is exposed. If the amount of light on the photo sensor 82 is high, the photo sensor's resistance becomes relatively low. If the amount of light on the photo sensor 82 is low, the photo sensor's resistance becomes relatively high.

In ambient light, the photo sensor 82 has a certain resistance which causes voltage $V_A$ to be less than a reference voltage $V_B$. Voltage $V_A$ and reference voltage $V_B$ are the positive and negative inputs, respectively, of operational amplifier IC1A. When voltage $V_A$ is less than reference voltage $V_B$, the operational amplifier IC1A output voltage $V_{M1}$, goes to negative, i.e., $V_{M1}$ is at zero voltage. When voltage $V_{M1}$ is at zero voltage, the motor 88 will not operate.

Note that the reference voltage $V_B$ is determined by and adjusts according to the ambient light level in a room. Therefore, the reference voltage $V_B$ is not preset to any particular light level. A reference voltage circuit 104 sets the reference voltage $V_B$ according to the ambient light level of a room. Because the reference voltage circuit 104 sets the reference voltage $V_B$ according to the ambient light level in a room, no adjustments need to be made to the dispenser 10 based on how high or low the ambient light level is for a particular room. Furthermore, the combination of the photo sensor 82 and the reference voltage circuitry 104 permit the photo sensor 82 to trigger the dispenser 10 when a person's hand comes within approximately 10–12 inches from the sensor 82.

The reference voltage circuit 104 includes resistors R2 and R3 and capacitor C1. Resistors R2 and R3 are connected to the positive terminal, SOLAR PANEL+, of the solar panel 96 which provides a voltage $B_+$ when the solar panel 96 is exposed to light. In ambient light, voltage $V_A$ is approximately 0.5 ($B_+$).

When a person places an obtrusion such as their hand within a predetermined distance of the photo sensor 82, preferably within 10–12 inches, the amount of light reaching the photo sensor 82 is decreased sufficiently to cause the photo sensor's resistance to increase to a level where voltage $V_A$ becomes greater than voltage $V_B$ and thereby causes the output $V_{M1}$ of operational amplifier IC1A to be a positive voltage.

The operational amplifier IC1A output voltage $V_{M1}$ is passed through diode D1 and is coupled to the positive input of operational amplifier IC1B. Reference voltage $V_C$ is provided between resistors R5 and R6 and is the negative input of operational amplifier IC1B. If voltage $V_{M1}$ is greater than reference voltage $V_C$, then the output of the operational amplifier IC1B, $V_{M2}$, is at a positive voltage. When the output voltage $V_{M2}$ is at positive voltage, n-p-n transistor Q1 is closed, thereby causing a current to flow through coil CL1 which in turn closes coil relay RLY1. When RLY1 is closed, the motor 88 runs because the motor's positive terminal, MOTOR+, is connected to the battery's positive terminal, BATTERY+.

In order to stop the motor 88 from turning after a predetermined amount of towel sheeting 50 has been dispensed, a roller sensing circuit 106 is provided. The roller sensing circuit 106 includes a magnet, 108, an n-p-n transistor Q3, a capacitor C6, resistors R7 and R8 and a reed switch RD1. The magnet 108 is mounted on drive roller 32. The magnet 108 activates or closes the reed switch RD1 when the magnet 108 is aligned with the reed switch RD1. When the reed switch RD1 is closed, a one time voltage drop is made across capacitor C6. The voltage drop across capacitor C6 turns on transistor Q3 which causes voltage $V_{M1}$ to drop to less than reference voltage $V_C$ and therefore produces a negative output or zero voltage output $V_{M1}$ from operational amplifier IC1B and stops the motor 88 from operating. By changing the radius of the drive roller 32, the length of paper 50 that is dispensed can be varied.

The time it takes for the motor 88 to turn the drive roller 32 one full turn, i.e., the time it takes for the magnet 108 to become aligned with reed switch RD1, is approximately 0.47 seconds. When the drive roller 32 has made one full turn, the predetermined amount of towel sheeting 50 has been dispensed and the magnet 108 is aligned again with the reed sensor RD1 to stop operation of the motor 88, as described above. Preferably, the motor 88 will power an approximately 3–4 inch diameter roller for one revolution, sufficient to dispense approximately 10–12 inches of paper towel 50. If the reed sensor RD1 is not activated within 1.0 second, e.g., if a paperjam occurs, a safety time circuit 110 turns the motor 88 off.

The safety timer circuit 110 includes capacitor C2 and resistor R4. If the reed switch RD1 does not sense the magnet 108 within 1.0 second, the safety time circuit 110 causes voltage $V_{M1}$ to drop below reference voltage $V_C$ and thereby causes output voltage $V_{M2}$ to be at zero volts and turns the motor 88 off.

When the front cover 24 is open, e.g., to add towel sheeting 50 in the dispenser 10, the motor 88 is prevented from operating by a door safety circuit 120. The door safety circuit 120 includes resistors R5 and R6, a reed switch RD2 and a magnet 121. One lead 122 of the reed switch RD2 is attached to resistor R5 and the other lead 124 is attached to ground G2. Reference voltage $V_C$ is created between resistors R5 and R6. When the front cover 24 is open, the reed switch RD2 is open and causes voltage $V_C$ to be higher than voltage $V_{M1}$ and therefore causes the output voltage, $V_{M2}$, of operational amplifier IC1B to be at zero voltage. Note that voltage $V_{M2}$ is never higher than voltage $B_+$.

When the front cover 24 is closed, the magnet 121 causes the reed switch RD2 to close and allows reference voltage $V_C$ to be less than voltage $V_{M1}$, which in turn causes the output voltage $V_{M2}$ of operational amplifier IC1B to be at positive voltage and turns the motor 88 on.

In ambient room light, the solar panel 96 generates enough current to power the control circuitry 98. In the preferred embodiment (shown in FIG. 5), the solar panel 96 generates enough current to also charge the battery 90. In this preferred embodiment, a positive lead, SOLAR PANEL+, of the solar panel 96, is connected to battery charging circuitry 126.

The battery charging circuitry 126 includes a diode D5, resistors R11 and R16, a capacitor C4 and a p-n-p transistor Q2. The positive lead, SOLAR PANEL+, of the solar panel 96 charges capacitor C4 through resistor R16. When capacitor C4 is charged to a certain voltage level, preferably approximately 1.2 volts higher than the battery voltage $B_+$, resistor R11 biases the capacitor C4 to discharge through the p-n-p transistor Q2 and into the positive terminal, BATTERY+, of the battery 90. As long as light reaches the solar panel 96, the battery charging process will be repeated and the solar panel 96 continually charges the capacitor C4 and battery 90.

In the second embodiment (not shown), the solar panel 96 only provides power to the control circuitry 98. Disposable, D-cell batteries (not shown) or other disposable batteries can be used to power the motor 88, instead of the rechargeable battery 90. Because the control circuitry 98 is powered by the solar panel 96, the motor 88 will not operate unless there is light in the room, thus preventing the disposable batteries from becoming unnecessarily discharged. After the disposable battery has been fully discharged, the disposable battery can be replaced.

The control circuitry 98 also includes delay circuitry 112 to prevent the dispenser 10 from starting a new cycle of dispensing towel sheeting 50 until a predetermined time after the motor 88 has turned off from a prior dispensing cycle. The predetermined time is preferably approximately 2 seconds. The delay circuitry 122 includes a diode D2, resistor R3, and capacitor C1.

When voltage $V_{M2}$ is high, the motor 88 is running and causing towel sheeting 50 to be dispensed from the dispenser 10. When $V_{M2}$ is high, capacitor C1 is charge to a very high level, forcing reference voltage $V_B$ very high. It takes approximately 2 seconds for $V_B$ to return to its ambient light level setting. During that time, if a person places their hand in front of the photo sensor 82, voltage $V_A$ will not be forced higher than $V_B$. As a result, the motor 88 cannot be turned on again until approximately 2 seconds after it has been turned off. This prevents a continual discharge of towel sheeting 50 from the dispenser which could cause the battery 90 to discharge and the motor 88 to burn out.

Figure 6:
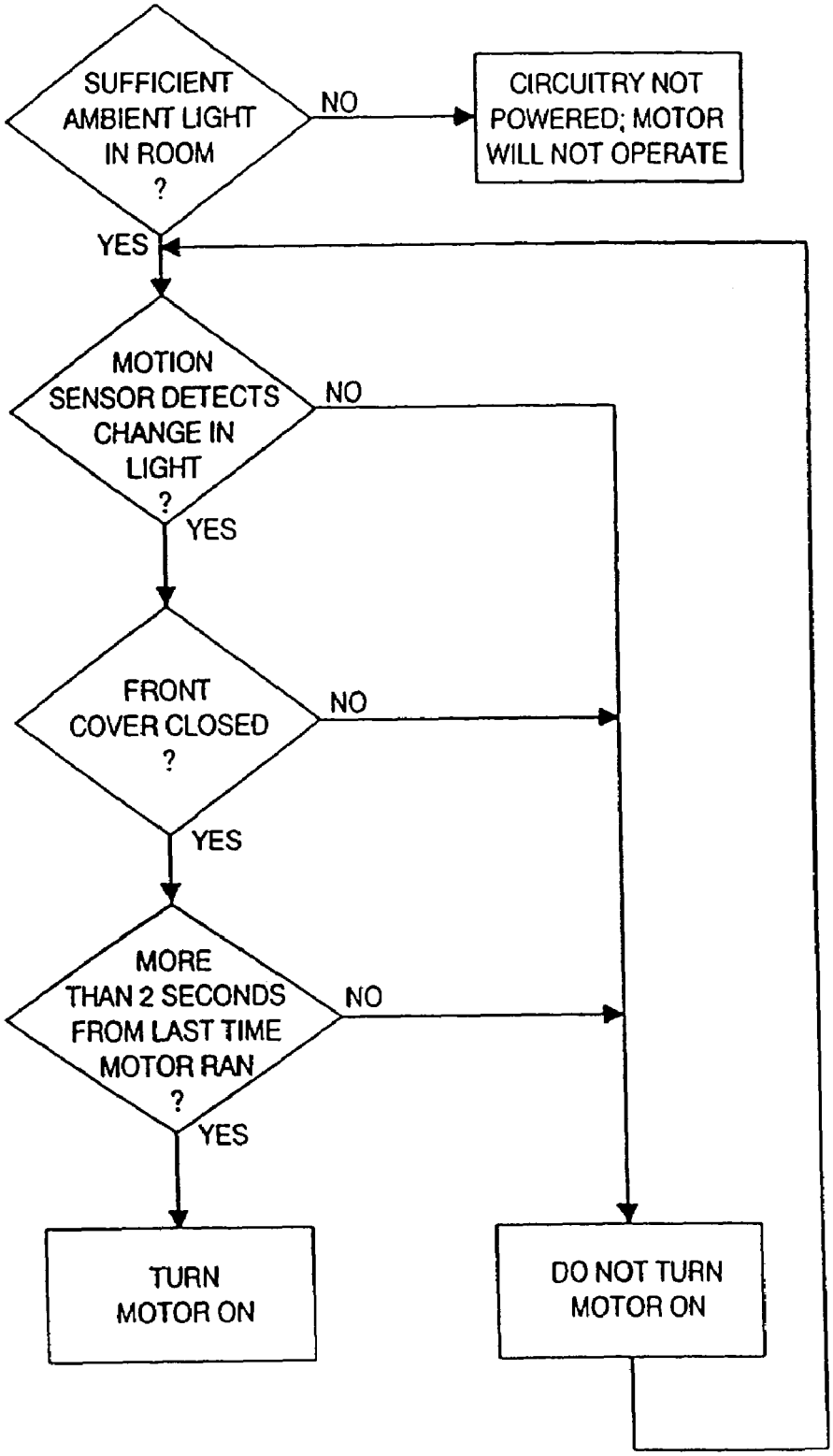
FIG. 6 is a block diagram describing operation of the hands free dispenser.
Figure 7:
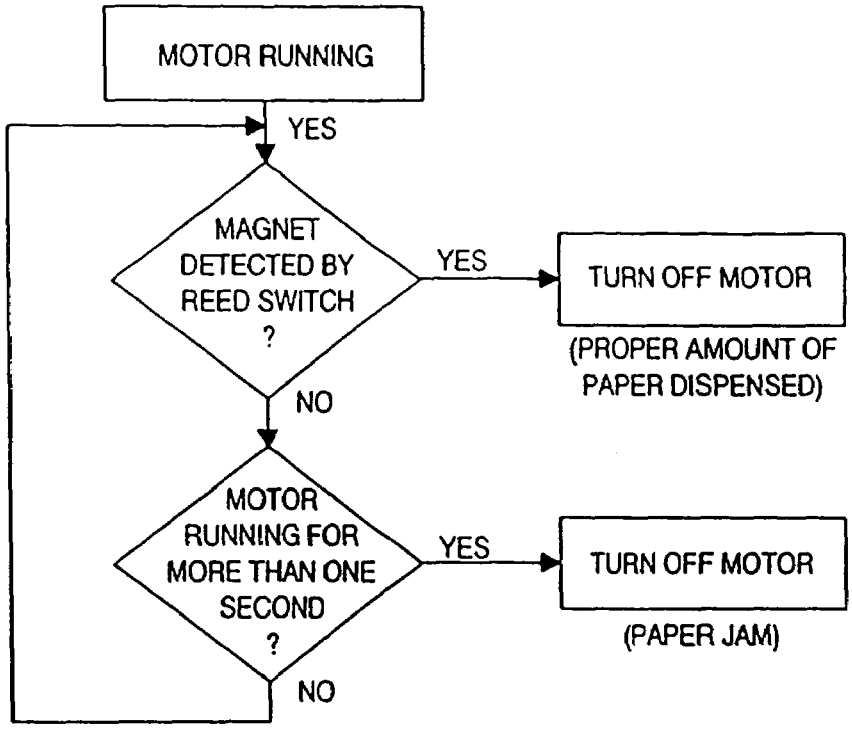
FIG. 7 is a block diagram describing operation of the safety shut off feature of the dispenser.

The manner in which the motor 88 is turned on is described in the flowchart of FIG. 6. The motor 88 cannot be turned on if there is not enough ambient light in the room to power the control circuitry 98. The solar panel 96 acts as an "on-off" switch for the dispenser 10 and will not permit the dispenser 10 to dispense towel sheeting 50 unless there is sufficient light in the room. If there is sufficient light in the room to power the control circuitry 98, the various checks, which have been described above with reference to the circuitry in FIG. 5, are shown in the flowchart of FIG. 6. These checks are performed before the motor 88 is turned on.

Figure 8:
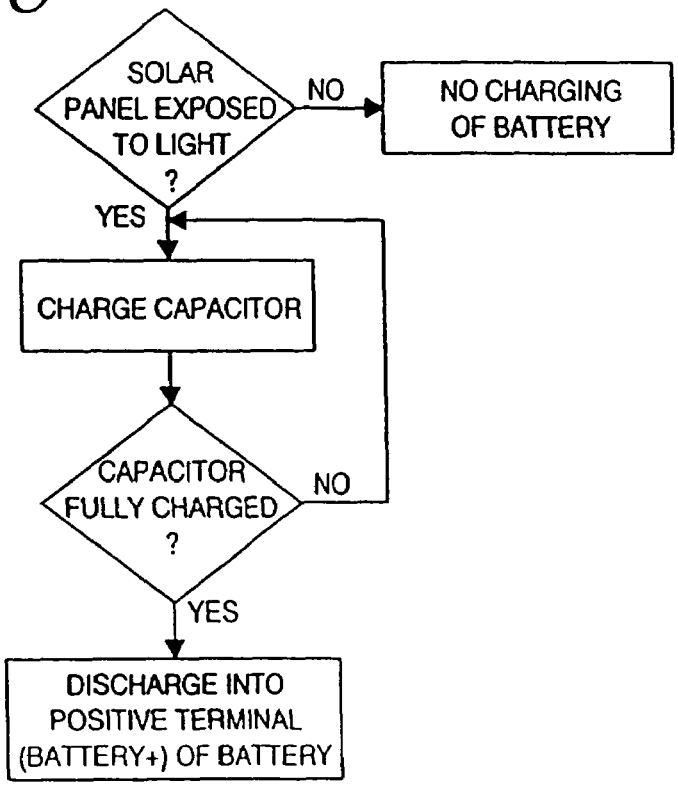
FIG. 8 is a block diagram describing how the battery is charged by the array of one or more photovoltaic cells.

The manner in which the motor 88 is turned off, which has been explained above with reference to FIG. 5, is described in the flowchart in FIG. 8. Similarly, the charging of the battery 90 by the solar panel 96, which has been explained above with reference to FIG. 5, is described in the flowchart of FIG. 8.

The embodiments of the inventions disclosed herein have been discussed for the purpose of familiarizing the reader with novel aspects of the invention. Although preferred embodiments have been shown and described, many changes, modifications, and substitutions may be made by one having skill in the art without necessarily departing from the spirit and scope of the invention.

What is claimed is:

1. A hands-free paper towel dispenser, comprising:

(a) a cabinet defining an interior space sufficient to house a main paper towel roll, the cabinet including a housing defined by a plurality of walls and a front cover that is pivotally attached to the housing so that the front cover is pivotable between an open position and a closed position;

(b) a sensing mechanism mounted to the housing in a direction facing the front cover and disposed entirely within the interior space of the cabinet at a location adjacent to the front cover, the sensing mechanism configured to detect through the front cover an object positioned outside of the cabinet and adjacent the front cover without the object contacting the front cover, and at least a portion of the sensing mechanism is accessible when the front cover is at the open position;

(c) a dispensing mechanism disposed within the housing for dispensing a length of towel, the dispensing mechanism including a drive roller and a motor in driving engagement with the drive roller;

(d) control circuitry that controls operation of the sensing mechanism and the motor, controls the length of towel that is dispensed, and provides a delay between cycles of towel dispensing; and (e) an electric power source for powering operation of the dispenser.

2. The dispenser of claim 1, wherein the sensing mechanism comprises a photo sensor.

3. The dispenser of claim 1, wherein the control circuitry includes a circuit that prevents operation of the motor when the front cover is in the open position.

4. The dispenser of claim 1, wherein the electric power source supplies non-alternating current.

* * * * *